US005496079A

United States Patent [19]

Frolov

[11] Patent Number: 5,496,079

[45] Date of Patent: Mar. 5, 1996

[54] SWINGING ELECTROMAGNETIC LOCK

[75] Inventor: George Frolov, Farmington, Conn.

[73] Assignee: Harrow Products, Inc., Grand Rapids, Mich.

[21] Appl. No.: 319,955

[22] Filed: Oct. 6, 1994

[51] Int. Cl.[6] ..... E05C 17/56

[52] U.S. Cl. ..... 292/251.5

[58] Field of Search ..... 292/92, 144, 251.5, 292/341.16

[56] References Cited

U.S. PATENT DOCUMENTS

| | | | |
|---|---|---|---|
| 3,934,909 | 1/1976 | Van Natter | 292/251.5 |
| 4,487,439 | 12/1984 | McFadden | 292/251.5 |
| 4,915,431 | 4/1990 | Bailey | 292/251.5 |
| 5,065,136 | 11/1991 | Frolov | 292/251.5 |
| 5,141,271 | 8/1992 | Geringer | 292/251.5 |
| 5,184,854 | 2/1993 | Chen | 292/251.5 |
| 5,184,855 | 2/1993 | Waltz | 292/251.5 |
| 5,376,910 | 12/1994 | Geringer | 292/251.5 |

FOREIGN PATENT DOCUMENTS

| | | | |
|---|---|---|---|
| 727369 | 2/1966 | Canada | 292/251.5 |

*Primary Examiner*—Steven N. Meyers
*Assistant Examiner*—Gary Estremsky
*Attorney, Agent, or Firm*—Chilton, Alix & Van Kirk

[57] ABSTRACT

A security system, responsive to a threshold force applied to a door, has a lock frame adapted for mounting to a door frame. A housing having an electromagnet mounted thereto swingably mounts to the lock frame. An armature, attractable to the electromagnet, mounts to the door. The housing swings on an axis substantially perpendicular to the door frame header. A pin fixed to the housing extends into the lock frame to limit the swinging of the housing between a first maximum and a second maximum position. A spring disposed between the housing and the lock frame urges the housing toward the first maximum position and sets a threshold force. A microswitch generates a signal upon swinging of the housing relative to the frame when the force of the spring is overcome by a force applied to the door.

20 Claims, 5 Drawing Sheets

SWINGING ELECTROMAGNETIC LOCK

BACKGROUND OF THE INVENTION

This invention relates generally to electromagnetic locks which control the access through doors. More particularly, this invention relates to electromagnetic locks responsive to door motion for controlling egress or entrance through an associated doorway.

Electromagnetic door locks are well-known in the art not only for locking characteristics, but also as key components in systems which control the opening and closing of doors for security and safety sensitive areas. For many doorways, simple locked and unlocked states for a door are not sufficient for security and safety concerns. Time delays for the release of an electromagnetic lock have been employed to enhance the security of entrance and egress through a particular doorway. Dramatic improvements in safety and security have been provided by locks which are automatically responsive to a force applied to a door to initiate a delay interval on the order of 15 to 30 seconds before allowing the door to open. The time delay incorporated into a lock operation allows security or safety personnel time to investigate the circumstances of an attempted opening of a particular doorway before the lock automatically releases and the door actually opens.

Frolov et al U.S. Pat. No. 5,065,136, assigned to the assignee of the present invention, discloses an electromagnetic door security system responsive to an application of force to the door for which the lock has been installed. The electronic lock may automatically respond to an application of force to the door by either immediately sounding an alarm and releasing the lock or initiating a time delay sequence before the lock releases and allows the door to open. The delay in the release of an electromagnetic lock is employed to provide appropriate security or safety personnel time to respond to an unauthorized egress or entrance through a particular door. The lock may also immediately trigger an alarm system for the warning of either security or safety concerns.

Frolov et al U.S. Pat. No. 5,065,136 discloses an electromagnet which is mounted for rocking movement in a lock frame. The rocking mount is provided by a pair of coaxial pivot pins having an axis which is substantially coplanar with the door frame header on which the lock is mounted. An armature attractable to the electromagnet is mounted to the door. The electromagnet rests in a first position relative to the lock frame under the force of gravity. A force applied to the door and therefore the armature results in the electromagnet rocking to a second position relative to the frame. This rocking motion activates a switch in the lock to generate a signal. The activation signal may result in an instant release of the electromagnet, a time delayed release of the electromagnet, and/or triggering of an alarm system.

SUMMARY OF THE INVENTION

Briefly stated, the invention in a preferred form is an improved electromagnetic lock system responsive to a force applied to a door. An electromagnet is mounted to a magnet housing that is swingably attached to a lock frame. The lock frame is mounted to the door frame. An armature attractable by the electromagnet is mounted on the door. When the door is closed and locked by the energized electromagnet magnetically bonding with the armature, the electromagnet housing is disposed in a first angular position relative to the lock frame. The application of a force to the door to open the door causes the electromagnet housing to swing to a second angular position relative to the lock frame. The swinging action activates a switch and triggers a signal to the lock control mechanism. The signal can be employed in a number of ways. An alarm can be triggered at the door location and/or at a remote location. The electromagnet can be immediately released thereby allowing the door to open, or a timing sequence can be initiated to delay the electromagnet from releasing and the door opening.

The swinging action of the electromagnet housing within the lock frame is obtained by locating the swing axis proximate one end of the electromagnet housing. The swing axis is perpendicular to the longitudinal axis of the electromagnet and the electromagnet housing.

The lock is preferably responsive to a preset threshold magnitude of force applied to the door through operation of a preset threshold actuation force mechanism. The electromagnet is in the first angular position when substantially no force is applied to the door. The force threshold sensing mechanism prevents the housing from swinging to the second angular position until a force greater than a preset threshold limit is applied to the door. In the preferred embodiment, a spring is disposed between the housing and the lock frame to bias the housing toward the first angular position. When sufficient force is applied to the door to overcome the force of the spring, the housing swings to the second angular position.

In a preferred embodiment of the invention, the responsiveness of the electromagnetic lock to a force applied to the respective door for which the lock is installed can be adjusted. The adjustment allows a force below a preset actuation threshold magnitude to fail to trigger the door lock switch. The number of false alarms and inadvertent lock releases can thereby be reduced.

A discriminator may be provided to determine from which side of an entranceway a force is applied to the door. The discriminator generates a direction signal which can be processed by the lock control mechanism. The lock system then selectively responds to the applied force by either initiating an opening sequence and/or signaling an alarm corresponding to the side of the door from which an opening is being attempted. For example, an attempted opening of a door could typically automatically result in an immediate or time delayed release of the lock if attempted from a first side of the door, yet be processed as an unauthorized entrance and signal an alarm with no lock release if attempted from the second side.

An object of the invention is to provide a new and improved electromagnetic lock that reliably responds to an opening force applied to an associated door for initiating a lock release greater than a preset threshold, when such force is applied to a door employing the locking system.

Another object of the invention is to provide a new and improved electromagnetic lock which is responsive to an opening force applied to a door and incorporates means for establishing a threshold activation force.

A further object of the invention to provide a new and improved electromagnetic door locking system that may be mounted horizontally or vertically on a door frame.

A yet further object of the invention is to provide a new and improved electromagnetic door system lock of efficient construction that is readily adjustable for a given application and is relatively inexpensive to manufacture.

These and other objects of the invention will be apparent from the drawings and the specification.

DETAILED DESCRIPTION OF THE PREFERRED EMBODIMENT

Figure 1:
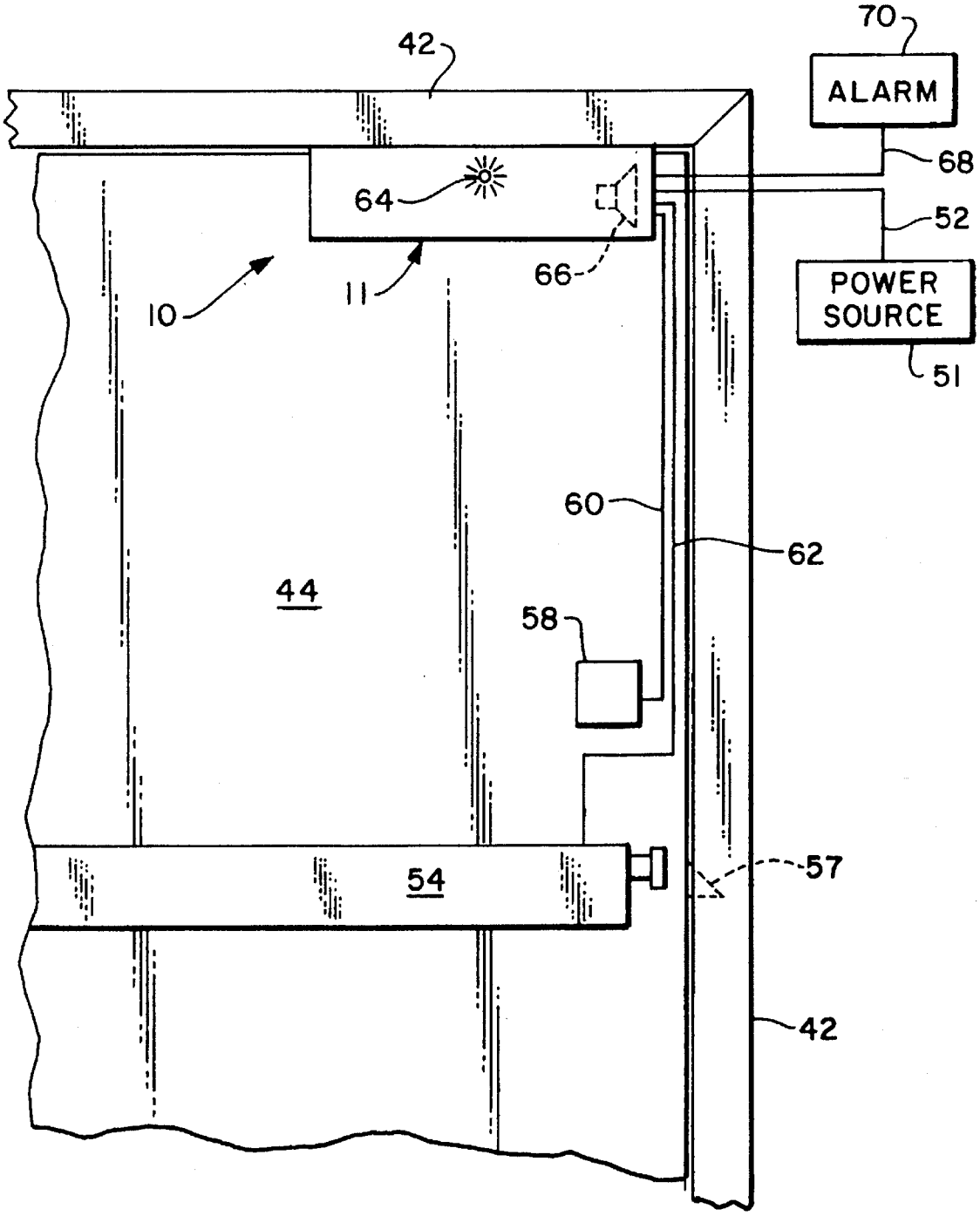
FIG. 1 is a schematic view of a door security system which employs a swinging electromagnetic lock in accordance with the invention illustrated in conjunction with a door frame and an exit door and a latch mechanism therefor.

With reference to the drawings wherein like numerals represent like parts throughout the figures, a door security system in accordance with the present invention is generally designated by the numeral 10. The door security system incorporates a swinging electromagnetic lock 11. In the preferred embodiment, the electromagnetic door lock 11 comprises an electromagnet 12 fixed to a housing 22. The housing 22 is pivotally mounted in a frame 14 to permit limited swinging in an arc about a vertical axis.

The electromagnet 12 comprises an elongated E-shaped core 13 which receives a coil 16 of insulated wire through which a current is passed. The electromagnet 12 is mounted to the housing 22 by means of bolts 24. The electromagnet defines an attraction surface 13. When the electromagnet 12 is energized, the electromagnet is attracted to an armature 17.

The armature 17 is mounted to the door by a bolt 46 which is captured in a cavity 48 of the armature 17. A conical steel washer 50 surrounds the bolt 46 and is interposed between the armature 17 and the door 44. This washer 50 allows the armature 28 to have limited universal movement relative to the door in such a manner that it may remain in intimate contact with the electromagnet when the electromagnet is energized. The armature 17 must be capable of a few degrees movement relative to the door 44 to maintain this optimum contact. The end of the bolt 46 is threaded and is captured by nut 52. For some applications (not illustrated), the armature can simply comprise a mass of ferrous material 18 attractable to the electromagnet 12.

Figure 2:
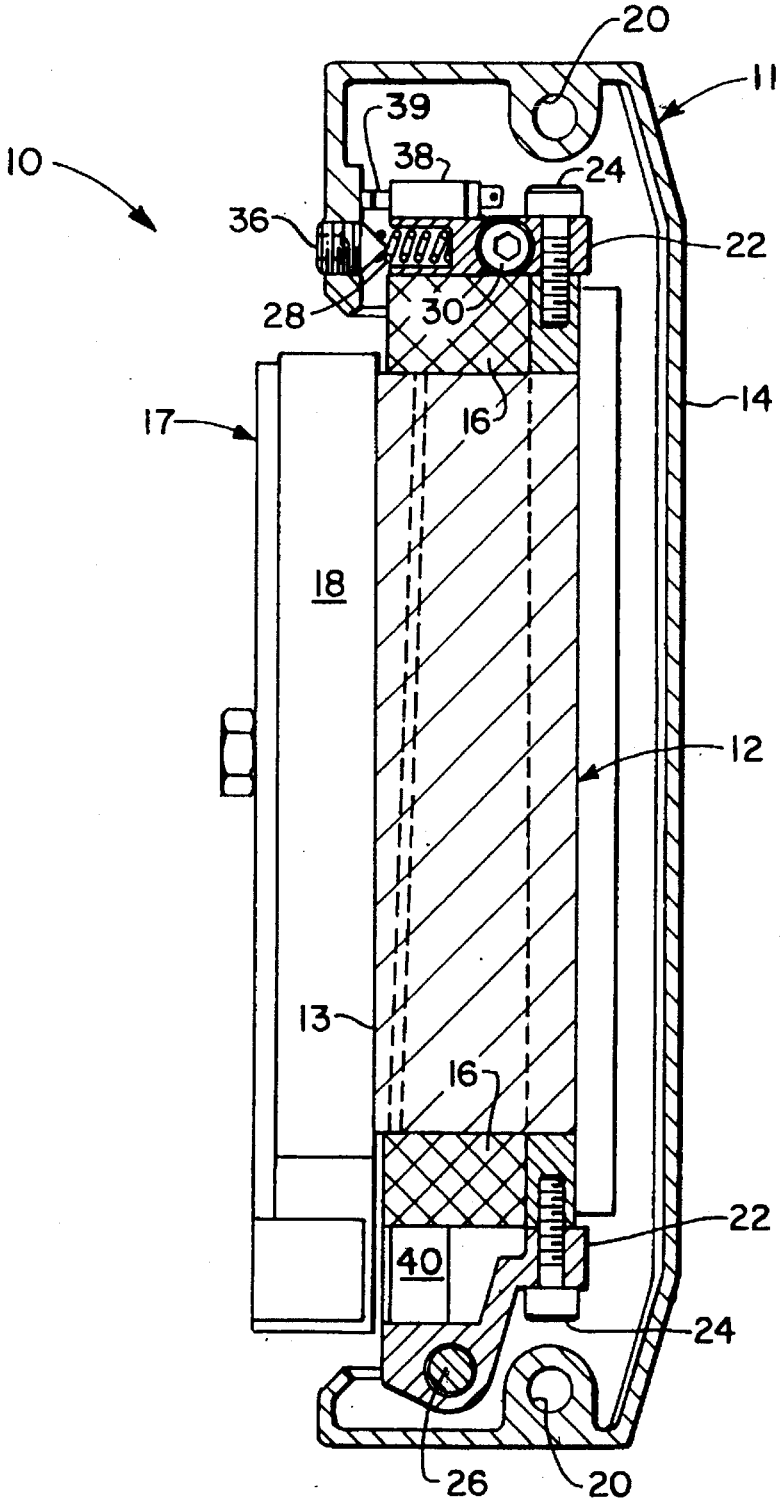
FIG. 2 is a partial cross-sectional view of the electromagnetic lock of FIG. 1 together with an associated armature viewed from the top thereof.
Figure 4:
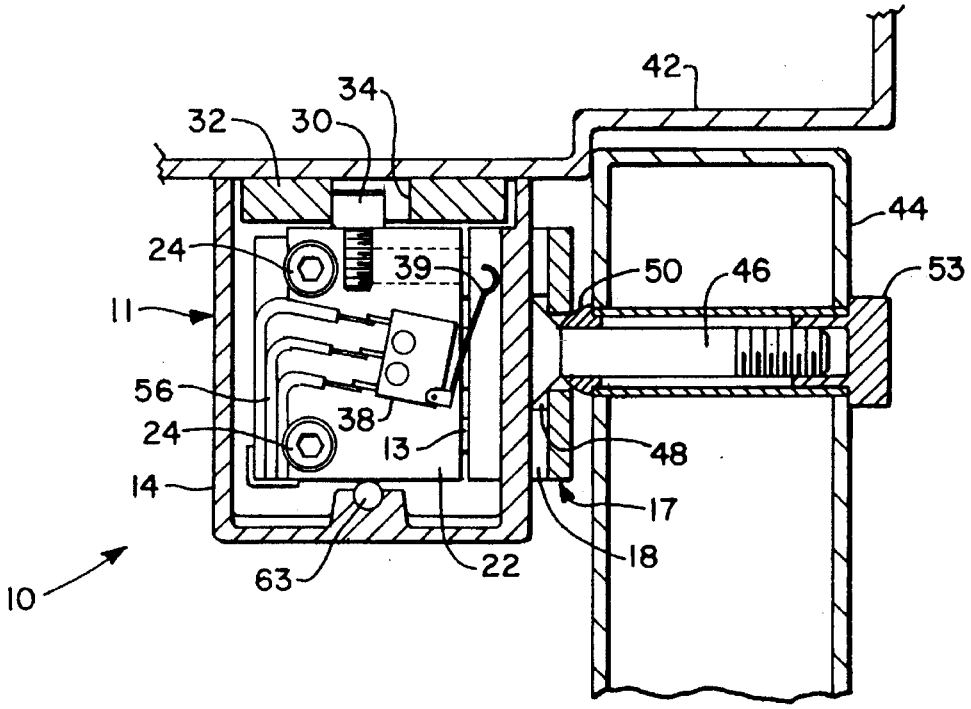
FIG. 4 is a partial, cross-sectional view of the electromagnetic door lock of FIG. 2 mounted to a door frame opposite a door and in a position where no opening force is applied to the door.
Figure 5:
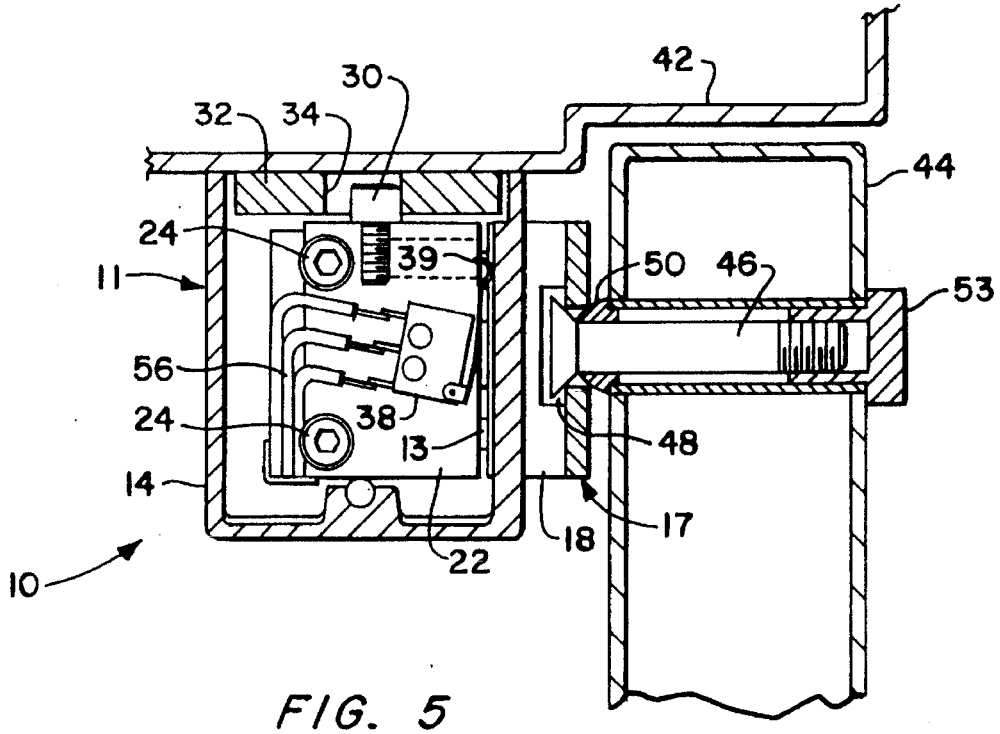
FIG. 5 is a partial cross-sectional view of the electromagnetic door lock, door frame and door of FIG. 4 in a state where an opening force has been applied to the door.
Figure 6:
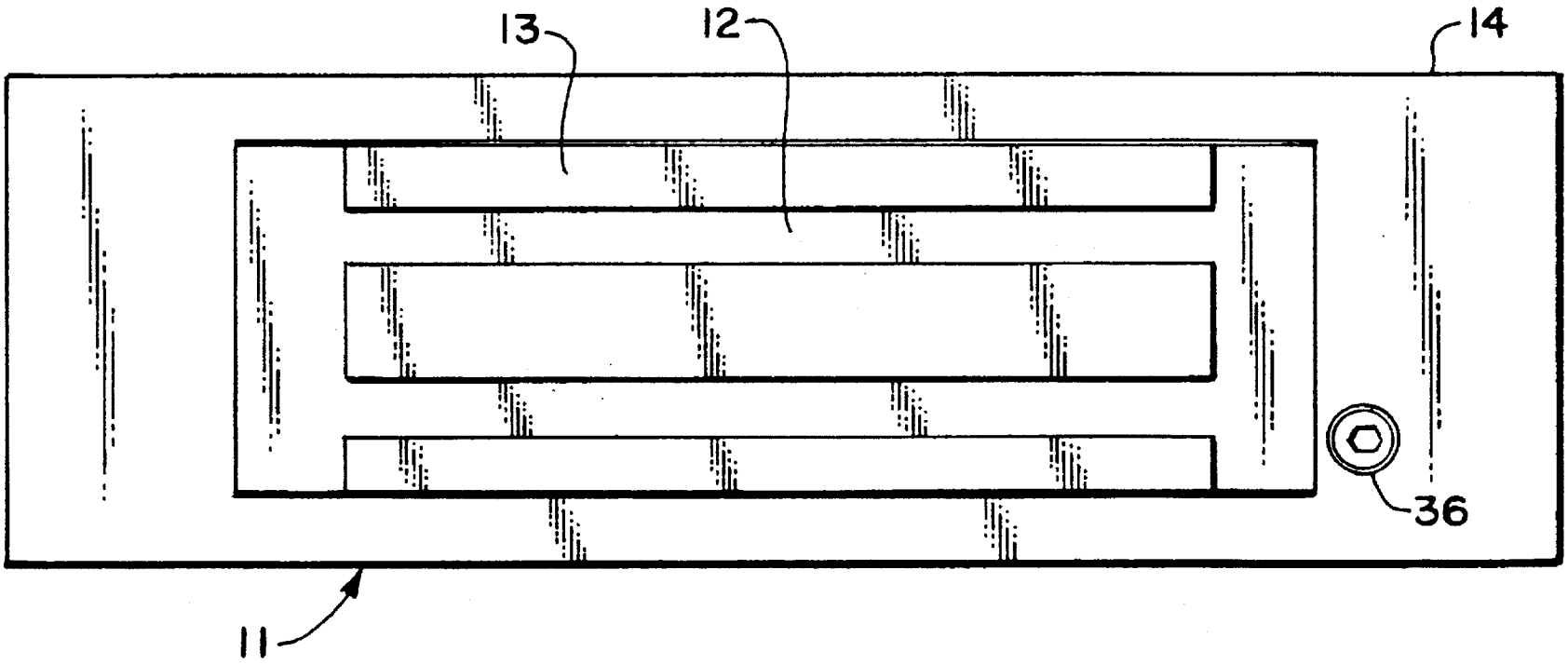
FIG. 6 is a front view of the electromagnetic door lock of FIG. 2.

Frame 14 has two mounting bores 20. Bolts (not shown) extend into the mounting plate 32. The frame 14 has an elongated polygonal shape defined by a slightly tapered back panel. The face of the frame 14 defines an opening framing the electromagnet 12 (as best illustrated in FIGS. 2 and 6). The frame 14 defines a rectangular cross section (as illustrated in FIGS. 4 and 5). The frame further includes an upper mounting plate 32 and a bottom support plate 33.

The housing 22 is pivotally mounted to the frame 14 by means of a pivot pin 26 located at one end of the housing. The pivot pin 26, can be simply a shouldered bolt extending through the housing 42 between the support plate 33 and the mounting plates 32 to allow the housing 22 to swing in a defined arc within the frame 14. The pivot pin 26 is oriented on an axis parallel to the axis of the swing of the door 44 when the electromagnetic lock 11 is mounted to the underside of the header of the door frame 42. The pivot axis of pin 26 is substantially perpendicular to the underside surface of the door frame 42 or the exterior surface of the mounting plate. The pivot axis of pin 24 is also orthogonal to a central longitudinal axis through the electromagnet and a central longitudinal axis through the elongated housing 22. If the lock is mounted to the side of door frame 42, the axis of the pivot pin 26 is perpendicular to the orientation of the axis that defines the swing of the door 44. In either mounting orientation, the axis of the pivot pin is substantially parallel to the attraction surface 13.

Figure 3:
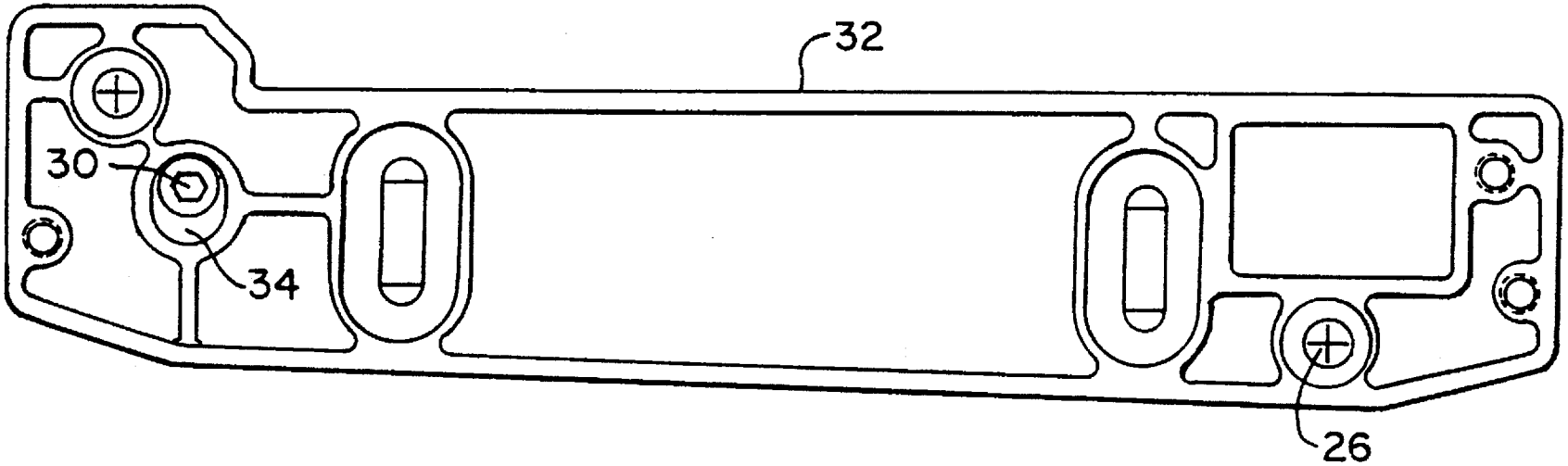
FIG. 3 is an interior view of the outer frame mounting plate of the electromagnetic lock of FIG. 1 viewed from the bottom thereof.

The housing and electromagnet define a swing path within the frame. The maximum arc distance the housing 22 may move inwardly in the frame away from the door 44 is limited by a pin 30 to thereby define a first maximum position. The end of housing 22 distally located from the pivot is supported on the bottom of the housing by a roller bearing 62 which allows for smooth movement of the housing 22 when the housing 22 swings about pin 30. FIG. 3 is an interior view of the upper mounting plate 32 of the lock system 10. The pin 30 is captured within a slot 34 located in the mounting plates 32 which allows the pin 30 to move along an arc defined by pivot 26. The slot 34 defines the swing path of the housing, providing maximum limits of motion defined as the first maximum and the second maximum positions of the housing 22. The stop end of the pin, which may be simply a screwhead extending into the slot, defines the first maximum position and the second maximum position by contacting opposite edges of the slot.

In the preferred embodiment, a coiled spring 28 is located at the distal end of the housing from the pivot 26. The spring 28 is located such that it is interposed between the housing 22 and the frontal side panel of the frame 14. The spring biases the housing 22 away from the associated door 44.

With reference to FIG. 2, the amount of compression on the spring 28 as it maintains the housing 22 in a first angular position away from the door can be adjusted by means of a set screw 36 threaded into the frame 14. The set screw 36 is accessible for adjustment at the frontal panel of the frame. Adjustment of set screw 36 will increase the compression on the spring 28, therefore placing a greater force on the housing 22 to maintain it in a first angular position away from the front of the frame and therefore the door. As a result, a threshold force greater than the spring force must be applied to the door, and consequently the armature 17, to urge the housing 22 forward into a second angular position.

It is recognized that the spring 28 may be interposed between the housing and the frame at numerous locations along the longitudinal extent of the housing away from the pivot 26. The spring 28 is preferably placed at the end of the housing 22 farthest from the pivot pin 26 to obtain the greatest sensitivity and discrimination of forces below the preset threshold. This results from the spring axially compressing over the greatest distance possible. With reference to FIG. 6, the set screw 36 can be seen as having an Allen socket which is accessible at the front of the frame for adjustment of the spring 28. The compression of the spring can simply be adjusted by opening the door and rotating the set screw 36 until the desired amount of compression in the spring is reached. The compression of the spring requires that a preset threshold amount of force be applied to the door before the switch 38 is activated. Small forces applied to the door will not inadvertently release the lock or sound alarms.

Such small forces could be the result of wind, inadvertent bumps by people walking past the door, or other similar occurrences.

A bi-stable switch 38, preferably a microswitch, is also located at the distal end of the housing 22. The switch 38 is positioned in such a manner that when the housing is in the first angular position away from the door, the switch is in one state and when the housing 22 is in a second position closer to the door, the switch changes to a second state. The first angular position can be, but is not necessarily the same as the first maximum position defined by the pin 30 interacting with slot 34. Due to slight variations in orientation of the door, armature, door frame and lock, the lock may never reach the first maximum position. Therefore, the switch will typically activate at an angular position between the first and second maximum swing positions of the housing.

The switch 38 is activated by the arm 39 of the switch 38 contacting against the interior frontal side panel of the frame 14. Depending on the application to which the electromagnetic security system is employed, the switch 38 may be in a permanent "on" state when the housing is in the first angular position and change to an "off" state when the housing moves from the first angular position to the second angular position. The reverse may also be true, where the switch is in a permanent "off" state when the housing is in the first angular position and changes to an "on" state when the housing moves from the first angular position to the second angular position.

The operation of switch 38 may be appreciated by reference to FIG. 4 which is a partial cross-sectional view of the door security system 10 mounted to a door 44 and a door frame 42. FIG. 4 represents the position when no force is being applied to the door and door frame to which the lock system is mounted. When the housing 22 is in the first maximum position as shown in FIG. 4, the pin 30 captured within slot 34 will generally engage the back of slot 34 or a position proximate thereto. The arm 39 of microswitch 38 is in the extended position when the housing is in this first angular position thereby placing the switch in a first state. It is also recognized that the switch could be mounted on the frame with the switch arm contacting the housing. Additionally, the housing can be in the first angular position without being at the first maximum position.

A magnetic switch or switches 40 are also fixed to the housing 22. The magnetic switch 40 interacts with a magnet on armature 17 to indicate whether the door is opened or closed.

FIG. 5 is a partial cross-sectional view of the door security system 10 mounted to a door frame and door when a force above the preset threshold is applied to the door. The housing 22 has swingably moved to the second maximum position. In this position, the door 44 moves slightly away from the door frame 42 and swings the housing 22 to the second maximum position. The motion of the housing 22 is limited by the interaction of the pin 30 within the slot 34. The engagement of the pin 30 within the slot 34 may receive all of the resistance force to the door opening until the electromagnet releases, unless some other mechanical means of restricting the door from opening is provided. In this position, the arm 39 of the switch 38 places the switch in a second state. As previously described, the lock may be in the second angular position to activate the switch before reaching the second maximum position.

The signal generated by the second state of the switch is transmitted along lines 56 to a location not shown for signal processing. This signal may be processed in a number of ways depending on the requirements of a specific application. In the preferred embodiment, the switch signal initiates a time delay sequence of 15–30 seconds where the magnet remains energized to hold the door in closed position and then releases to allow the door to open. In alternative embodiments, the switch could instantly release the electromagnet. Furthermore, the switch signal may also be employed to sound various alarms either at the location of the door, and/or at a remote location. Various applications of the signal generated by the swinging lock are disclosed in Frolov et al U.S. Pat. No. 5,065,136 which is incorporated by reference.

FIG. 1 shows the door security system 10 as installed in a doorway. For the electromagnetic lock 11 to lock the door, power must be provided from a power source 51 along line 52. In the event of an emergency such as fire, power is automatically interrupted to the lock 10 to instantly unlock the door. The door 44 may also have mechanical means such as a panic bar 54 connected to a latch 57 to secure the door.

Triggering of switch 38 can generate a signal which may be processed to activate an alarm at the location of the door, such as by a light 64 or by a siren 66. The signal from the switch may also be transmitted along a line 68 to a remote location to sound an alarm 70. Signal handling methods have been disclosed, for example, in Frolov et al U.S. Pat. No. 5,065,136, which has been incorporated by reference.

A discriminator to assess which side of the door a person is located can be an infrared sensor 58 mounted on one side of the door whereby the sensor sends a signal to the lock on line 60 or an electrical switch (not shown) mounted to the panic bar 54 whereby the switch sends a signal on line 62. Entry generally not permitted from a particular side of a door could be allowable by overriding the signal of a discriminator by use of a key system integrated into the locking system. Such a key system could include a mechanical key connected to an electrical contact, a card reader, a key pad or other similar security system device.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A security system for a door comprising:

frame means adapted for mounting a housing means to a door frame, said frame means having a mounting surface;

electromagnetic means for generating an electromagnetic field and defining an attraction surface;

said housing means comprising an elongated structure for housing said electromagnetic means, said housing means having a first end portion and a longitudinally spaced second end portion, said attraction surface disposed at one side of said housing means;

pivot means for pivotally mounting said first end portion of said housing means to said frame means, said pivot means defining a pivot axis substantially perpendicular to said mounting surface and parallel to said attraction surface; and switch means actuatable in response to pivotal displacement of said housing means relative to said frame means for generating a first electrical signal.

2. The security system of claim 1 wherein said switch means comprises a microswitch.

3. The security system of claim 1 wherein said switch means is located at the second end portion of said housing means.

4. The security system of claim 1 wherein the pivot means comprises a pivot pin swingably mounted to the housing means and fixed to the frame means.

5. The security system of claim 4 further comprising a bearing mounted to said frame means and slidably engageable with said housing means.

6. The security system of claim 1 further comprising armature means adapted for mounting to a door and attractable by said electromagnet for magnetic bonding therewith.

7. The security system of claim 1 wherein said housing means defines a swing path about said pivot means and further comprising limiting means for defining the angular limit of said swing path.

8. The security system of claim 1 wherein said frame means defines a slot; and said limiting means further comprises a pin mounted to said second end of said housing means, said pin extending into said slot.

9. The security system of claim 7 further comprising spring means disposed between said housing means and said frame means to urge said housing means toward the angular limit of said swing path.

10. A security system for a door comprising:

frame means for mounting a housing means to a door frame;

electromagnetic means for generating an electromagnetic field and defining an attraction surface;

said housing means having a central longitudinal axis and a first end portion and a longitudinally spaced second end portion for receiving said electromagnetic means;

pivot means for pivotally mounting said first end portion of said housing means to said frame means; said pivot means defining a pivot axis substantially orthogonal to said longitudinal axis;

switch means actuatable in response to swinging displacement of said housing means from a first angular position to a second angular position for generating a first electrical signal; and threshold force restricting means for restricting pivotal displacement of said housing means from said first angular position to said second angular position when a force is applied to the housing below a preset threshold.

11. The security system of claim 10 wherein the threshold force restricting means comprises a spring disposed between said housing means and the frame means.

12. The security system of claim 10 wherein said switch means comprises a microswitch having an actuator, said microswitch being mounted to said housing means and said actuator being engageable with said frame means.

13. The security system of claim 10 wherein said threshold force restricting means is adjustable.

14. The security system of claim 9 further comprising armature means adapted for mounting to a door and attractable by said electromagnet for magnetic bonding therewith.

15. The security system of claim 9 wherein the threshold force restricting means biases said housing means toward said first angular position.

16. A security system for a door comprising:

frame means adapted for mounting a housing means to a door frame, said frame means having a mounting surface;

electromagnet means comprising an elongated core defining a longitudinal axis for generating an electromagnetic field;

said housing means for housing said electromagnetic means;

pivot means for pivotally mounting said housing means to said frame means so that said housing means is swingable along a swing path about a pivot axis orthogonal to said longitudinal axis;

limiting means for limiting the angular extent of said swing path between a first maximum position and a second maximum position;

spring means for biasing said housing toward the first maximum position; and switch means for generating a electrical signal when the housing swings between said first maximum position and said second maximum position.

17. The security system of claim 16 wherein the frame means defines a slot; and said limiting means comprises a pin fixed to the housing means located within said slot.

18. The security system of claim 16 further comprising armature means adapted for mounting to a door and attractable by said electromagnet means for magnetic bonding therewith.

19. The security system of claim 16 wherein said switch means comprises a microswitch means having an actuator, said microswitch being mounted to said housing means and said actuator being engageable with said frame means.

20. The security system of claim 16 wherein said spring means comprises a spring disposed between said housing means and said frame means.

* * * * *